US008541671B1

(12) United States Patent
Burgett et al.

(10) Patent No.: US 8,541,671 B1
(45) Date of Patent: Sep. 24, 2013

(54) LOST MOTION COMPENSATION DEVICE FOR AN UPRIGHT PIANO ACTION

(75) Inventors: Kirk Burgett, Sacramento, CA (US); Jamie Marks, Haverhill, MA (US); Dana Mazzaglia, Haverhill, MA (US)

(73) Assignee: Wessell, Nickel & Gross, Sacramento, CA (US)

( * ) Notice: Subject to any disclaimer, the term of this patent is extended or adjusted under 35 U.S.C. 154(b) by 1 day.

(21) Appl. No.: 13/426,583

(22) Filed: Mar. 21, 2012

(51) Int. Cl.
*G10C 3/18* (2006.01)

(52) U.S. Cl.
USPC ..... 84/222

(58) Field of Classification Search
None
See application file for complete search history.

(56) References Cited

U.S. PATENT DOCUMENTS

| | | | | | |
|---|---|---|---|---|---|
| 788,203 | A | * | 4/1905 | Glatt | 84/222 |
| 803,752 | A | * | 11/1905 | Glatt | 84/222 |
| 808,190 | A | * | 12/1905 | Bothner | 84/222 |
| 812,705 | A | * | 2/1906 | Vogel et al. | 84/222 |
| 845,565 | A | * | 2/1907 | Metzger | 84/222 |
| 952,550 | A | * | 3/1910 | Vough | 84/222 |
| 963,837 | A | * | 7/1910 | Vogel et al. | 84/222 |
| 1,353,645 | A | * | 9/1920 | George | 84/222 |

* cited by examiner

*Primary Examiner* — David Warren
*Assistant Examiner* — Robert W Horn
(74) *Attorney, Agent, or Firm* — Craig A. Simmermon

(57) ABSTRACT

Lost motion compensation device is a mechanical device that rigidly and pivotally connects the rest rail of an upright piano to the front end of the whippen of an upright piano to cause the two member to rotate in unison as the rest rail is rotated by depressing and releasing the soft pedal on an upright piano.

1 Claim, 7 Drawing Sheets

LOST MOTION COMPENSATION DEVICE FOR AN UPRIGHT PIANO ACTION

BACKGROUND OF THE INVENTION

1. Field of the Invention

This invention relates to the soft pedal of an upright piano or more specifically the mechanism that are triggered by depressing the soft pedal of an upright piano. Depressing the soft pedal causes the playing of the piano to occur at a lower volume than that without depressing the soft pedal.

When the soft pedal is depressed to reduce the volume of the piano, a detrimental effect called "lost motion" occurs, where the piano key is depressed without any resulting motion of the hammer of the piano action. Lost motion is undesirable by the pianist. This invention removes lost motion resulting from the soft pedal of an upright piano.

2. Description of Related Art

The soft pedal mechanism reduces piano playing volume by rotating the entire row of hammers of a piano action slightly towards the piano strings, thereby moving the hammers of the piano actions closer to the piano strings. This rotation results in less distance for the hammers to travel in order to strike the piano strings, yielding less time for the hammers to accelerate before striking the piano strings. This results in lower piano volumes brought about by lower energy hammer strikes on the piano strings.

As discussed in detail below, the rotation of the hammers in the piano causes gaps to appear between the jacks and the hammer butts of the piano actions. This gap is what creates lost motion. This invention is a device that attaches to each piano action of an upright piano that functions to rotate the row whippens along with the row of hammers in order to close the gap that causes lost motion.

BRIEF SUMMARY OF THE INVENTION

It is an aspect of this invention to provide a lost motion compensation device that may be attached to the whippen of an upright piano at one end of the device and attached to the rest rail of an upright piano at the other end of the device to cause the whippen to rotate along with the rest rail, as the soft pedal on the upright piano is depressed and released to move the rest rail.

It is an aspect of the lost motion compensation device to provide a rigid hinged connection between the whippen of an upright piano action and the rest rail of an upright piano to cause the whippen to rotate or move along with the rest rail as the rest rail is rotated or moved by depressing or releasing the soft pedal on an upright piano.

DEFINITION LIST

Figure 1:
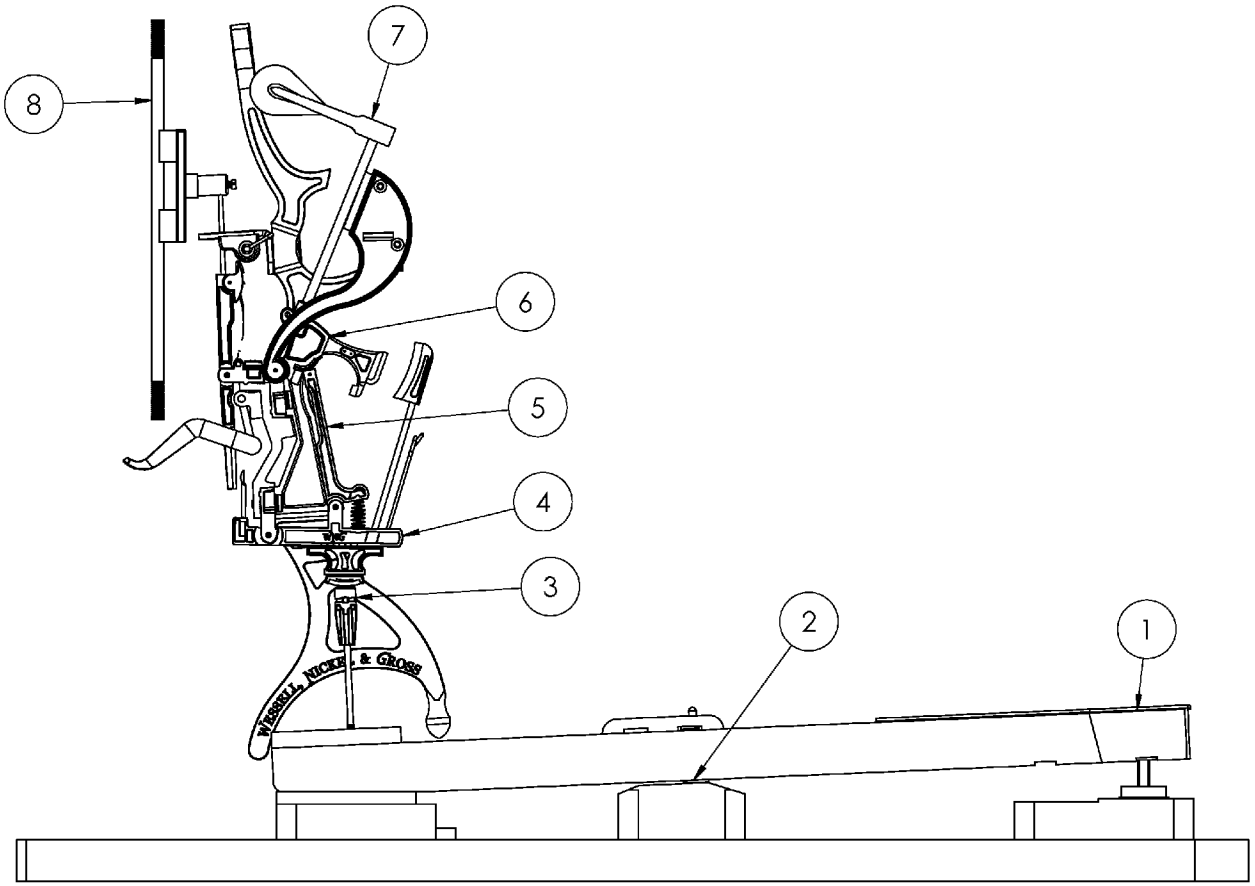
FIG. 1 is a side elevation view of a piano key, a piano action, a damper action, and a piano string of an upright piano action without the lost motion compensator device, with piano key at rest.
Figure 2:
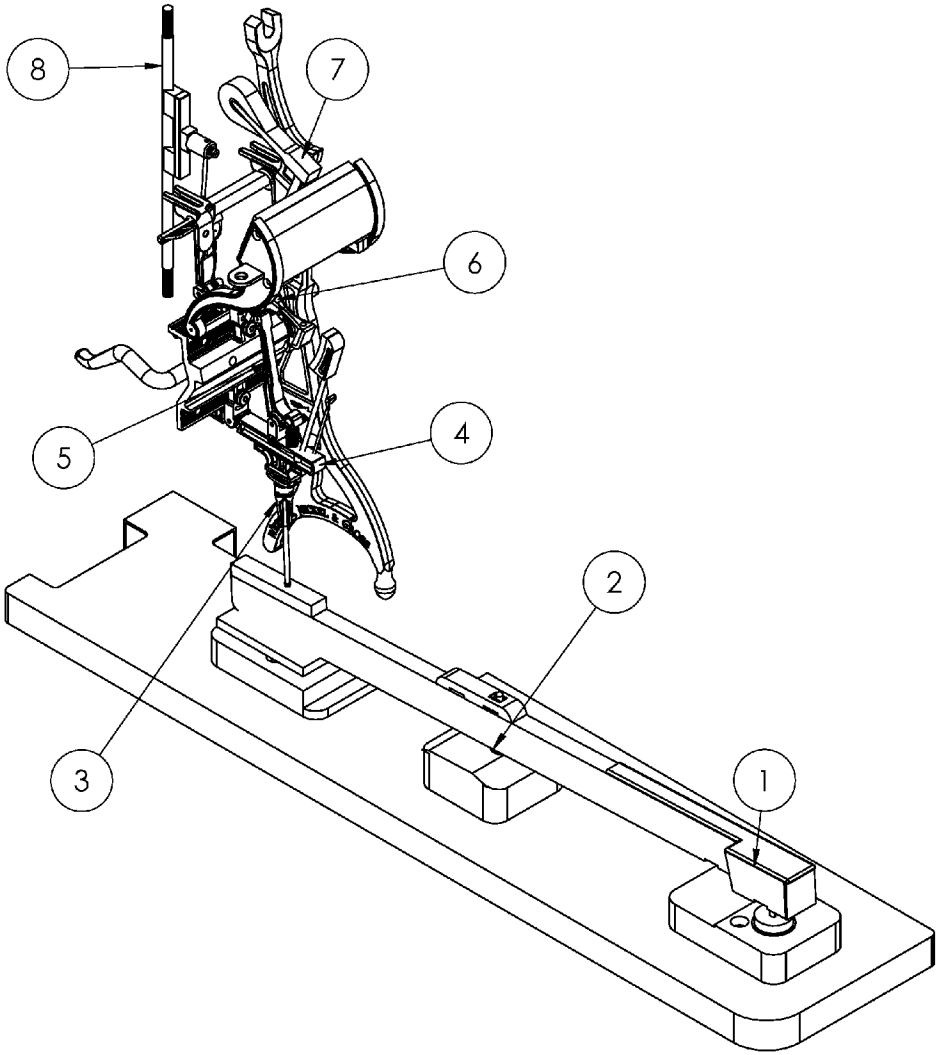
FIG. 2 is a prospective view of a piano key, a piano action, a damper action, and a piano string of an upright piano action without the lost motion compensator device, with piano key at rest.

| Term | Definition |
|---|---|
| 1 | Piano Key |
| 2 | Balance Point of Piano Key |
| 3 | Dowel Capstan |
| 4 | Whippen |
| 5 | Jack |
| 6 | Hammer Butt |
| 7 | Hammer Butt |
| 8 | Piano String(s) |
| 9 | Capstan/Whippen contact point |
| 10 | Jack/Hammer Butt contact point |
| 11 | Gap between Jack and Hammer Butt |
| 12 | Rest Rail at Full Strike Position |
| 13 | Rest Rail at Soft Strike Position |
| 14 | Rest Rail Cloth |
| 15 | Hammer Shank |
| 16 | Full Strike Distance |
| 17 | Soft Strike Distance |
| 18 | Lost Motion Compensating Lever |
| 19 | Lost Motion Rod |
| 20 | Lifter Clip |
| 21 | Lifter Rod |
| 22 | Lifter Connector |
| 23 | Lost Motion Lever Operated |

DETAILED DESCRIPTION OF THE INVENTION

An upright piano action comprises the following interconnected subcomponents: a dowel capstan 3, a whippen 4, a jack 5, a hammer butt 6, a damper lever (depicted, not labelled), a hammer shank 15, and a hammer 7. Basically, when a piano player presses down on a piano key 1, this causes the back side of piano key 1 to rise upwards in response. The back side of the piano key 1 then pushes upwards on the dowel capstan 3, which in turn pushes upwards on the whippen 4, causing the whippen 4 to rotate. As the whippen 4 rotates, it pushes on the damper lever, rotating the damper lever in the opposite direction, to lift damper off the piano string(s) 8. The rotating whippen 4 also pushes upwards on the jack 5, lifting the jack 5 upwards. Jack 5 in turn pushes upwards on hammer butt 6, causing the hammer butt 6 to rotate, which causes hammer shank 15 and hammer 7 to rotate. Rotation of hammer shank 15 causes the hammer 7 to strike one or more piano strings 8, thereby creating music or sound in the piano.

Figure 3:
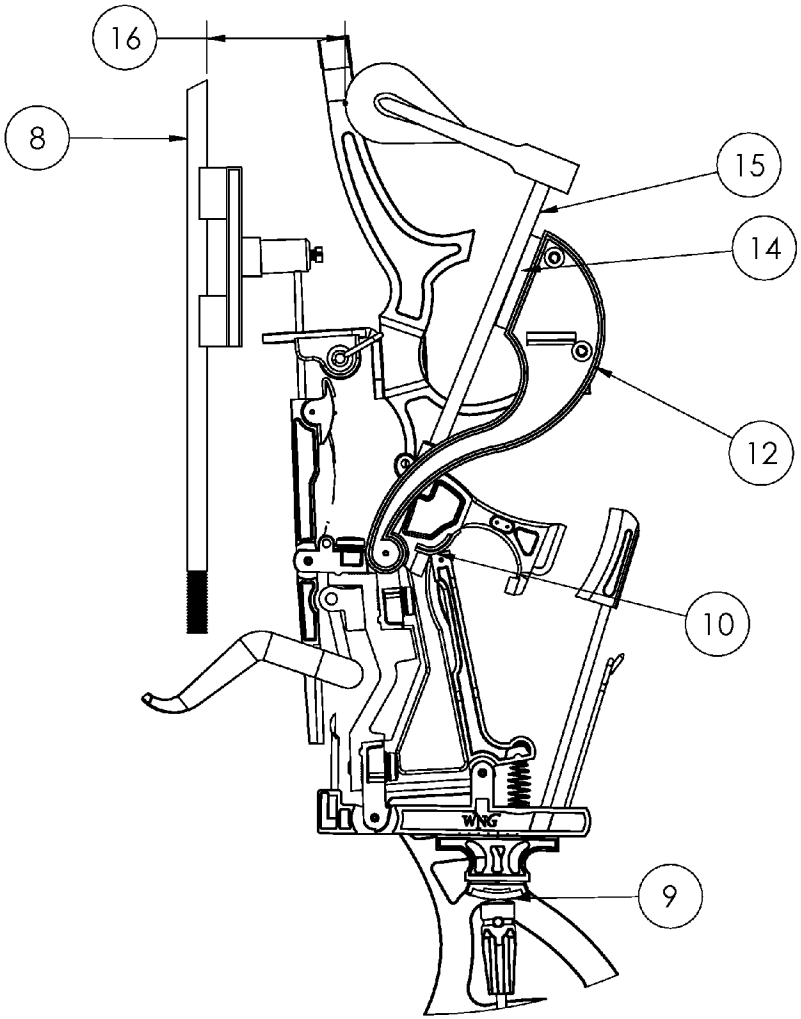
FIG. 3 is a blowup view of a piano key, a piano action, a damper action, and a piano string of an upright piano action without the lost motion compensator device, with piano key at rest, without depressing the soft pedal.

FIG. 3 depicts an upright piano action with both the soft pedal (not depicted) and the piano key 1 at rest and not depressed. We can see that the hammer shank 15 rests upon the rest rail cloth 14 and the rest rail 12. In FIG. 3, rest rail 12 is positioned at the full strike distance 16. As depicted, in this state, there is no gap between the jack 5 and hammer butt 6 at the location marked 10.

Figure 4:
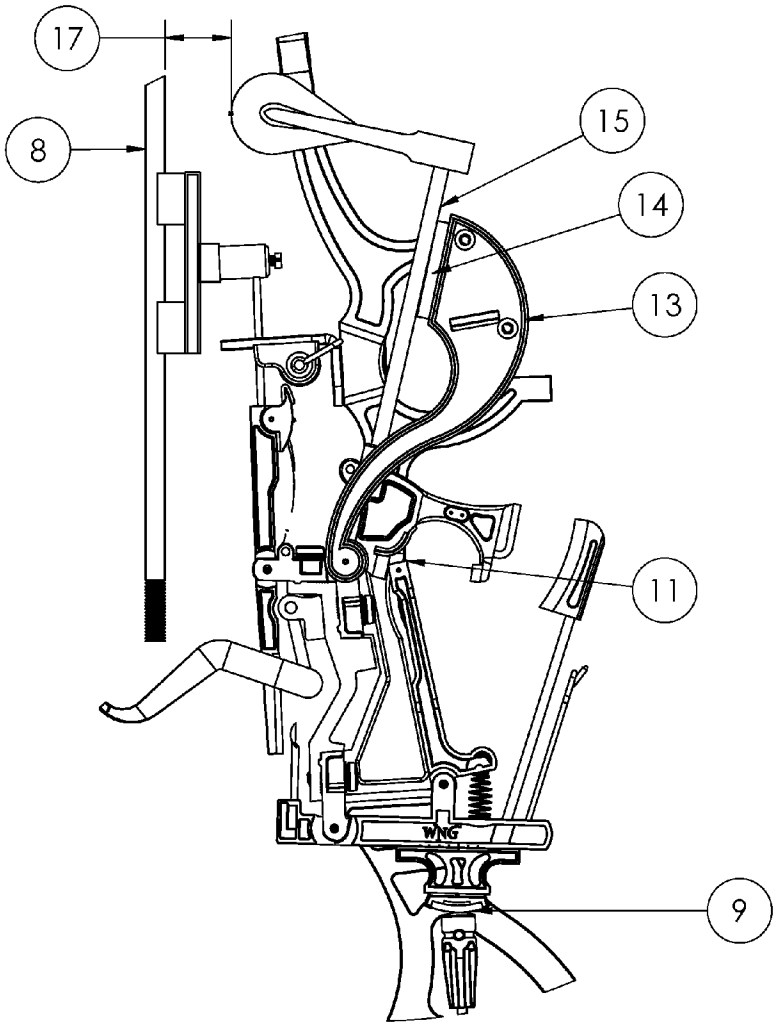
FIG. 4 is a blowup view of a piano key, a piano action, a damper action, and a piano string of an upright piano action without the lost motion compensator device, with piano key at rest, while depressing the soft pedal.

FIG. 4 depicts an upright piano action with the soft pedal fully depressed and the piano key 1 at rest. In FIG. 4, rest rail 13 is positioned at the soft strike distance 17. When the soft pedal is depressed, this rotates the rest rail of the piano action from position 12 to position 13, thereby changing the strike distances of the hammers 7 from distance 16 to distance 17. When this occurs, a gap 11 forms between jack 5 and hammer butt 6.

Gap 11 is what causes lost motion in the piano action. Lost motion results when the piano key 1 is depressed to raise jack 5, which rises by the length of gap 11 without touching hammer butt 6. Lost motion does not result in any movement of hammer 7. It is piano key motion without any corresponding hammer motion. Hence it is lost motion. Lost motion is a problem for most pianists.

To remedy lost motion, this invention uses a lost motion compensation device that causes the whippen 4 to rotate towards the piano strings 8 along with rest rail 12, 13, as the soft pedal is depressed. Rotation of the whippen 4 causes hammer butt 6 to rise along with the rest rail in order to prevent gap 11 from forming. This design prevents lost motion from occurring.

Figure 5:
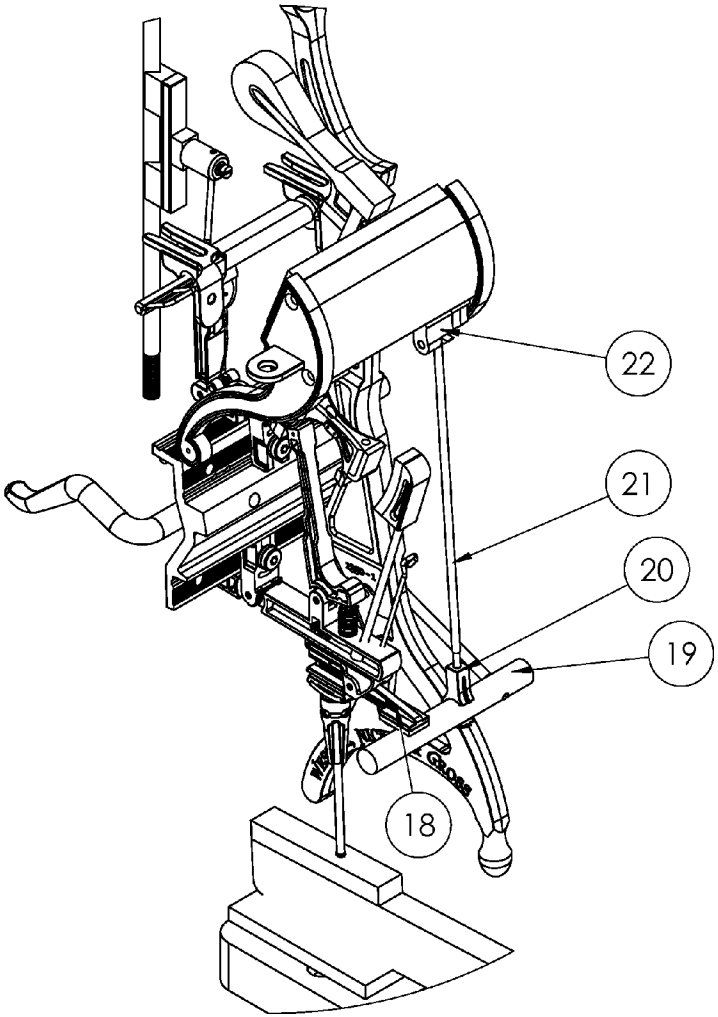
FIG. 5 is a prospective view a piano key, a piano action, a damper action, and a piano string of an upright piano action with the lost motion compensator device, with piano key at rest.

Referencing FIG. 5, lost motion compensation device comprises: a lost motion compensating lever 18, a lost motion rod 19, a lifter clip 20, lifter rod 21, and a lifter connector 22. Lifter connector 22 is attached to rest rail 12, 13 and functions to provide a hinged connection to lifter rod 21. Lifter rod 21 is a rigid oblong member connected to lifter connector 22 at one end and attached lifter clip 20 at the other end. Lifter clip 20 is attached to lost motion rod 19 and functions to securely connect lifter rod 21 to lost motion rod 19. Lost motion rod 19 is a rigid oblong member. Lifter rod 21 and lost motion rod 19 are positioned essentially perpendicular to each other where the lower end of lifter rod is attached to the middle area of lost motion rod 19. Lost motion rod 19 extends beyond whippen 4, to run just underneath whippen 4. Lost motion compensating lever 18 is a rigid oblong member that is rigidly connected to the heel of whippen 4 at the end opposite the piano strings 8. Lost motion compensating lever 18 is long enough to extend beyond lost motion rod 19 as depicted in the FIGS. 5-7.

With this design, as the soft pedal is depressed, thereby causing the rest rail 12,13 to rotate towards the piano stings 8, the soft pedal also lifts up on the heel of the whippen 4 and rotates the whippen 4 along with the rest rail 12,13 towards the piano strings 8. The lost motion compensation device is rigid structure with a hinged connection to rest rail 12, 13 that functions to cause the whippen 4 of an upright piano action to mirror the motion of the rest rail 12, 13 as the soft pedal is depressed and released. Thus, with the lost motion compensation device, the gap 11 between jack 5 and hammer butt 6 is eliminated.

Figure 6:
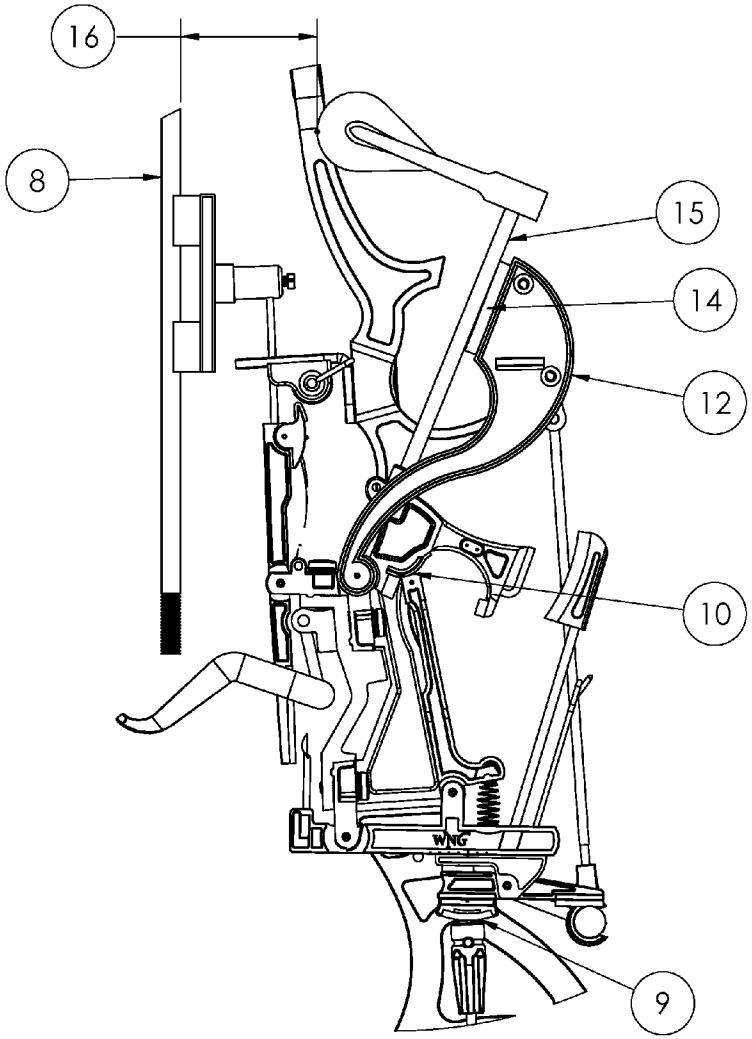
FIG. 6 is a blowup view of a piano key, a piano action, a damper action, and a piano string of an upright piano action with the lost motion compensator device, with piano key at rest, without depressing the soft pedal.

FIG. 6 depicts an upright piano action with both the soft pedal (not depicted) and the piano key 1 at rest and not depressed. We can see that the hammer shank 15 rests upon the rest rail cloth 14 and the rest rail 12. In FIG. 5, rest rail 12 is positioned at the full strike distance 16. As depicted, in this state, there is no gap between the jack 5 and hammer butt 6 at the location marked 10.

Figure 7:
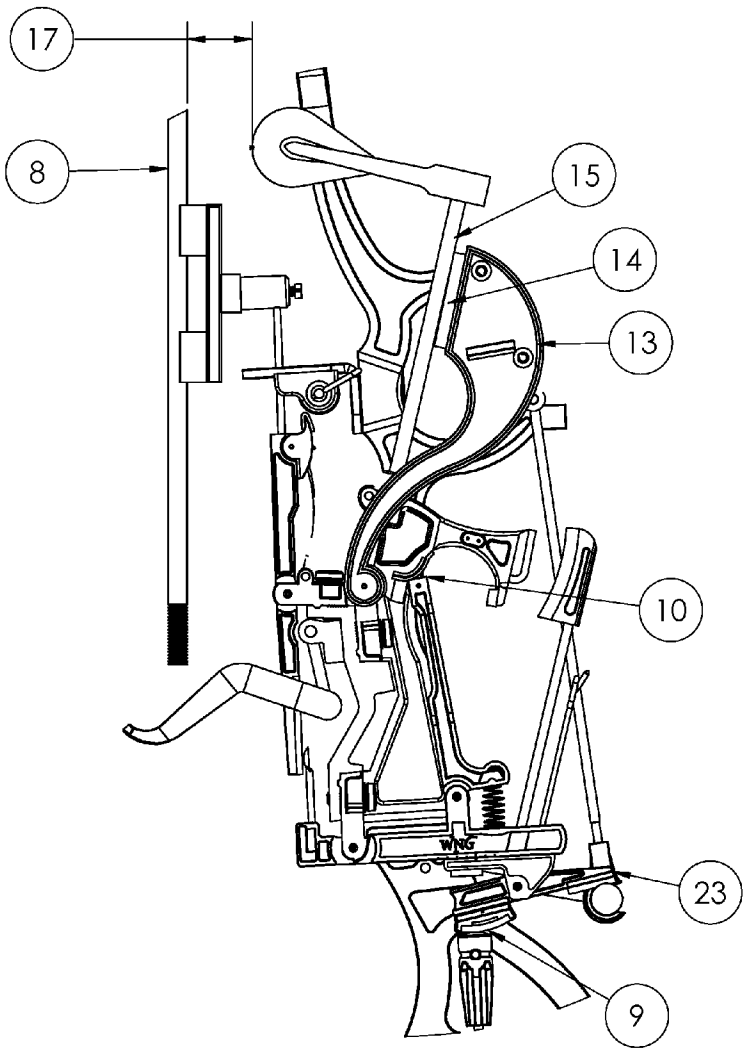
FIG. 7 is a blowup view of a piano key, a piano action, a damper action, and a piano string of an upright piano action with the lost motion compensator device, with piano key at rest, while depressing the soft pedal.

FIG. 7 depicts an upright piano action with the soft pedal fully depressed and the piano key 1 at rest. In FIG. 7, rest rail 13 is positioned at the soft strike distance 17. When the soft pedal is depressed, this rotates the rest rail of the piano action from position 12 to position 13, thereby changing the strike distances of the hammers 7 from distance 16 to distance 17.

The piano action in FIG. 7 includes a lost motion compensation device so we see that the lost motion compensation device pulls whippen 4 up along with rest rail 13, thereby preventing gap 15 from forming. Instead we see a gap-less connection at 10.

There must one lost motion compensation device attached to all piano actions in the piano. Thus, there are typically 88 lost motion compensation devices on each piano.

What is claimed:

1. A lost motion compensator for an upright piano comprising:

a lifter connector;

a lifter rod;

a lifter clip;

a lost motion rod; and a lost motion compensating lever, wherein, said lifter connector is rigidly attached to the rest rail of an upright piano, said lifter rod is a rigid oblong member with an upper end and a lower end, said upper end pivotally connected to said lifter connector and said lower end rigidly connected to said lifter clip, said lifter clip is rigidly attached to said lost motion rod and functions to securely connect said lifter rod to said lost motion rod, said lost motion rod is a rigid oblong member with a left end and a right end, positioned essentially perpendicular to said lifter rod, said lower end of said lifter rod securely attached to the right end of said lost motion rod, the length of said lost motion rod extends beyond the position of the whippen of the piano action, said lost motion compensating lever is a rigid oblong member with a far end and a near end, positioned essentially perpendicular to said lost motion rod, said far end rigidly attached to the heel of the whippen of an upright piano action, and said near end extending beyond said lost motion rod, so that, as the rest rail is rotated, the rest rail lifts with it said whippen as said left end of said lost motion rod pushes up on said near end of said lost motion lever.

* * * * *